United States Patent [19]

Ookawa et al.

[11] 4,073,093

[45] Feb. 14, 1978

[54] SOUNDPROOF DOOR

[75] Inventors: Taro Ookawa, Tokyo; Shuichi Takeda, Ichikawa, both of Japan

[73] Assignee: Yoshida Kogyo K.K., Tokyo, Japan

[21] Appl. No.: 715,111

[22] Filed: Aug. 17, 1976

[30] Foreign Application Priority Data

Aug. 18, 1975 Japan ..... 50-113573[U]

[51] Int. Cl.[2] ..... E06B 7/16

[52] U.S. Cl. ..... 49/381; 49/303; 49/396; 49/488

[58] Field of Search ..... 49/381, 501, 396, 484, 49/303, 475, 488

[56] References Cited

U.S. PATENT DOCUMENTS

| | | | |
|---|---|---|---|
| 559,686 | 5/1896 | Denman | 49/303 |
| 3,320,700 | 5/1967 | Bohn | 49/484 X |
| 3,462,899 | 8/1969 | Sherman | 49/484 X |

FOREIGN PATENT DOCUMENTS

| | | | |
|---|---|---|---|
| 1,460,957 | 10/1966 | France | 49/501 |
| 2,043 of | 1888 | United Kingdom | 49/501 |

*Primary Examiner*—Kenneth Downey

*Attorney, Agent, or Firm*—Hill, Gross, Simpson, Van Santen, Steadman, Chiara & Simpson

[57] ABSTRACT

A swinging door carries at its bottom end a pair of parallel spaced rollers which extend substantially the full width of the door and which, when the door is closed, are spring energized into rolling engagement with the bottom transverse member of a doorframe or sill for soundproofing the bottom of the door. A pair of horizontally elongated rubber strips, suspended from the door, rest on the respective rollers in order to obstruct the passage of sound above the rollers.

5 Claims, 4 Drawing Figures

SOUNDPROOF DOOR

BACKGROUND OF THE INVENTION

1. Field of the Invention

This invention relates to doors, and more specifically to a swinging door having improved means for making the same impervious to sound.

2. Prior Art

For soundproofing a swinging door, it has been common to form steps on the inside surfaces of a doorframe so that the door when closed may be engaged by the steps via sealing strips of resilient material. This known soundproof door construction has a disadvantage in connection with the step formed on the bottom transverse member of the doorframe or sill, as people passing through the doorway may stumble over the step. Such a step also presents an obstacle to the transportation rolling of heavy articles such as pieces of furniture through the doorway.

SUMMARY OF THE INVENTION

It is an object of this invention to provide improved means for soundproofing the bottom of a swinging door, such that the surface forming the bottom of a doorway or sill need not have any step, ridge or equivalent means formed thereon which would hamper the passage of people or heavy articles thereover.

Another object of the invention is to provide soundproofing means which is easy to mount on a door, which does not interfere with the opening and closing movement of the door, and which will remain highly operative for an extended length of time.

A further object of the invention is to provide soundproofing means which when mounted in position on the door, is substantially completely invisible, so that the external appearance of the door is not impaired in any way by the presence of the soundproofing means.

Briefly, the means herein disclosed is best characterized by at least one roller which is rotatably mounted at the bottom end of a swinging door and which extends substantially the full width of the door. When the door is in a closed position in a doorway, the roller makes rolling engagement with a surface forming the bottom of the doorway such as the top surface of the bottom transverse member of the doorframe. The surface engaged by the roller can be absolutely flat.

In order to enhance the soundproofing effect of the roller, the roller can be made of rubber or like resilient material and may further be yieldably urged by spring means into engagement with the surface forming the bottom of the doorway. If necessary, a soundproof screen or curtain of rubber or like can be suspended from the door so as to ride on the roller, thereby obstructing the passage of sound above the roller.

The above and other objects, features and advantages of this invention and the manner of attaining them will become more apparent, and the invention itself will best be understood, upon consideration of the following description taken in connection with the accompanying drawings showing a preferred embodiment of the invention.

DESCRIPTION OF THE PREFERRED EMBODIMENT

Figure 1:
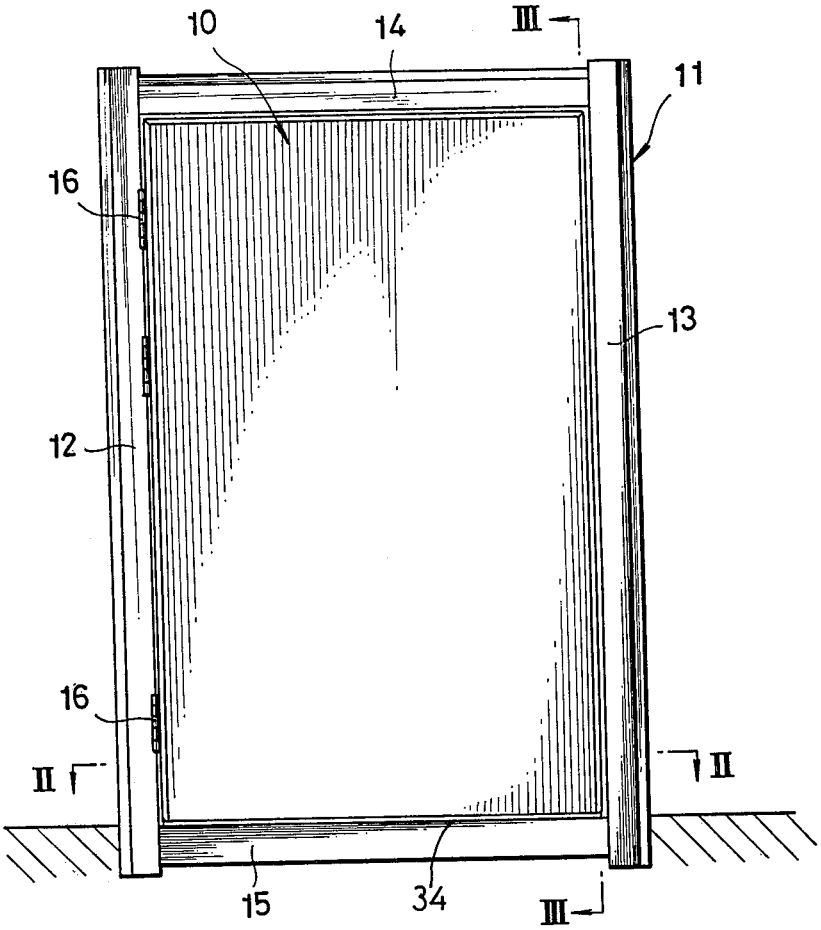
FIG. 1 is a front elevational view of a door-and-doorframe combination employing the soundproofing means of this invention.

In FIG. 1, a door 10 is swingably mounted within a doorframe 11 which comprises a pair of side jambs 12, 13 and a pair of top and bottom transverse members 14, 15, which are combined rectangularly in any convenient manner to define the doorway openably closed by the door 10. The door is hinged at 16 to the left side jamb 12.

Figure 2:
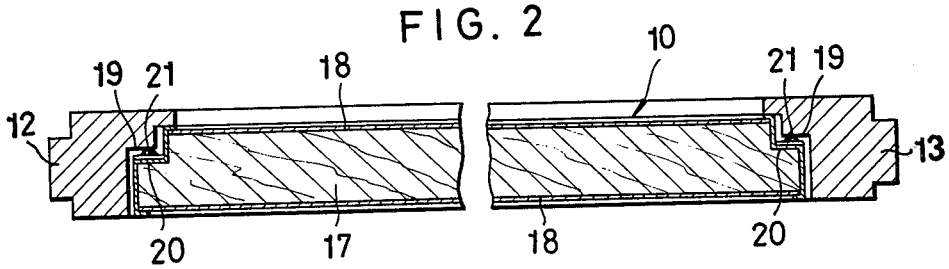
FIG. 2 is an enlarged horizontal cross-sectional view, partly broken away, that is taken along the line II—II of FIG. 1.
Figure 3:
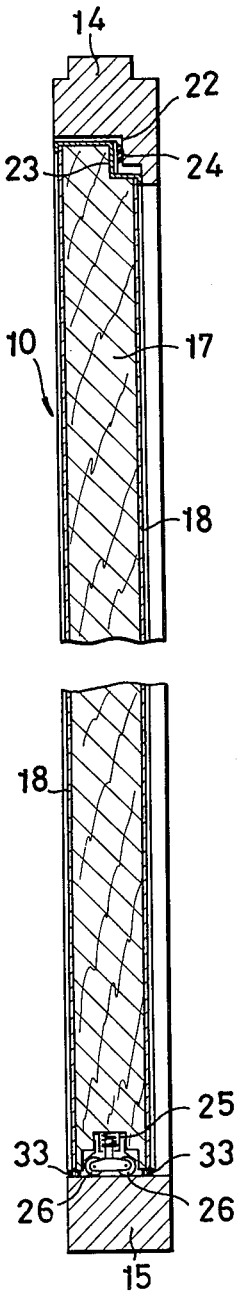
FIG. 3 is an enlarged vertical cross-sectional view, partly broken away, that is taken along the line III—III of FIG. 1.

As shown in FIGS. 2 and 3, the door 10 comprises a panel 17 of lumber-core plywood or the like and soundproof coverings 18 on both surfaces of the panel. The soundproof coverings 18 may be formed of any such material as woven fabric, carpet, felt, sheet aluminum, and sheet plastic having roughened surfaces.

A pair of steps 19 (FIG. 2) are on the opposed inside surfaces of the side jambs 12 and 13. Correspondingly, the door 10 has a pair of steps 20 on and extending along its vertical edges, and a pair of soundproof sealing strips 21 of rubber or like resilient material are attached to the door steps 20. The sealing strips 21 are pressed against the steps 19 on the side jambs 12, 13 when the door 10 is in a closed position within the doorframe 11 as shown.

FIG. 3 illustrates a similar step 22 formed on the inside surface of the top transverse member 14 of the doorframe 11, and a corresponding step 23 formed on and extending along the top edge of the door 10. A soundproof sealing strip 24 of rubber or the like is attached to the step 23 on the door 10 so as to be pressed against the step 22 on the top transverse member 14 when the door 10 is closed. The sides and top of the door 10 are thus made impervious to sound in accordance with the prior art.

Figure 4:
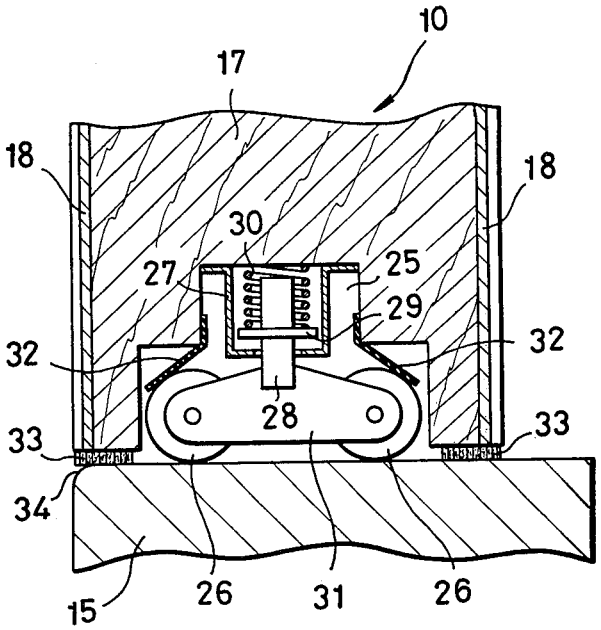
FIG. 4 is an enlarged view of a portion of FIG. 3.

As illustrated in FIG. 3 and on an enlarged scale in FIG. 4, the door 10 has a recess 25 of inverted T-shaped cross section formed in and extending along its bottom edge. Accommodated in this recess are one or more, two in the illustrated embodiment, rollers 26 of rubber or like resilient material which make rolling engagement with the top surface of the bottom transverse member 15 of the doorframe 11 for soundproofing the bottom of the door 10 in accordance with this invention.

A pair of hollow cylindrical members 27 (one shown), each closed at one end and flanged at the other, are fixedly mounted within the recess 25 at its opposite ends, with their flanged ends directed upwardly. A pin 28 having a collar 29 thereon is housed in each cylindrical member 27 and slidably extends downwardly therefrom through a hole formed in its closed bottom end. Also housed in each cylindrical member 27 is a helical compression spring 30 which engages the collar 29 on the pin 28 for yieldably urging the pin downwardly.

The bottom end of each pin 28, projecting out of the respective cylindrical member 27, is rigidly connected to a mounting plate 31. The pair of mounting plates 31 at the opposite ends of the recess 25 rotatably support therebetween the aforesaid pair of rollers 26 in parallel spaced relationship via washers or the like (not shown). When the door 10 is in the closed position, therefore, the pair of rollers 26 are yieldably urged against the top surface of the bottom transverse member 15 of the doorframe 11 under the bias of the compression springs 30. The spacing between the rollers 26 should be suitably determined for optimum soundproofing effects.

A pair of soundproof screens or curtains 32 in the form of strips of rubber or like relatively pliant material are provided to obstruct the passage of sound above the rollers 26. Each soundproof screen 32 is affixed at one of its transverse edges to one of the opposed surfaces of the door 10 defining the reduced width portion of the recess 25 and has its other transverse edge portion resting on one of the rollers 26 for relative sliding contact therewith. The screens 32 thus cooperate with the rollers 26 for soundproofing the bottom of the door 10.

According to a further feature of this invention, a pair of cleaning strips 33 of mohair or the like are attached to the bottom edge of the door 10 so as to be located on both sides of, and extend along the full length of, the pair of rollers 26. Each time the door 10 is opened or closed, the cleaning strips 33 slide over the top surface of the bottom transverse member 15 of the doorframe 11 to make it free from dust or any other foreign matter, thereby permitting the rollers 26 to make neat and positive contact therewith when the door is closed. The provision of these cleaning strips also contributes materially toward the prolongation of the service life of the soundproofing means.

Since the rollers 26 used in the illustrated embodiment of the invention are assumed to be of constant diameter throughout their length, it is desirable that the top surface of the bottom transverse member 15 be disposed higher than the floor on one of its sides toward which the door is to be swung open, only to such an extent that the rollers will not experience any substantial torsional stress while the door is being opened or closed. As clearly shown in FIG. 4, the bottom transverse member 15 should preferably be rounded or bevelled at 34 to eliminate the step which might otherwise exist between the member 15 and the floor. The bevel 34 thus makes the top surface of the bottom transverse member 15 substantially flush with the floor for all practical purposes, without impairing the soundproofness of the door 10 in any way.

If it is desired to make the top surface of the bottom transverse member 15 exactly coplanar with the floor, there may be employed a taper roller or rollers which become gradually smaller in diameter toward their ends located at the hinged side of the door. Alternatively, the roller or rollers may be transversely divided into a plurality of sections capable of rotation independently of each other.

As will also readily occur to those having ordinary knowledge in the art, an additional soundproof strip of rubber, plastic or like material may be suspended from the top of the recess 25 so as to lie between the pair of rollers 26. Such an additional strip will coact with the soundproof screens 32 to more positively obstruct the passage of sound above the rollers 26.

All these and other modifications within the usual knowledge of those working in this art, however, are considered to fall within the scope of this invention. It is also understood that the foregoing specifically described door construction is merely illustrative of the principles of the invention.

What is claimed is:

1. In a sound-insulating door construction adapted to be mounted for pivoting about a vertical axis in a doorway having a bottom surface, the combination comprising:

a. means defining a downwardly facing channel extending along the width of the door in its lower edge;

b. an elongated roller supported on the door in said channel and projecting therefrom for rolling engagement with said bottom surface, said roller being spaced along its length from said channel-defining means; and c. an elongated sound-insulating screen disposed in said channel and secured to said door, and tangentially engaging said roller along its length for obstructing the passage of sound between said roller and said channel-defining means.

2. A combination according to claim 1 including a second elongated roller and a second elongated screen disposed along and in parallel to said first-named roller and screen, and similarly supported and arranged, whereby two successive and independent sound barriers are provided along said bottom surface, and two successive and independent sound barriers are provided in a path above said rollers.

3. A combination according to claim 1 in which the tangential engagement of said screen is along a line above a horizontal plane to the roller's axis of rotation.

4. A combination according to claim 1 including a pair of cleaning strips secured to the bottom face of the door, respectively along opposite sides of said channel and extending along the width of the door and adapted to wipe clean the bottom surface each time that said roller is about to move over it in door-opening and door-closing movement.

5. A combination according to claim 4 in which said cleaning strips comprise mohair.

* * * * *